US008130154B2

(12) United States Patent
Iizuka

(10) Patent No.: US 8,130,154 B2
(45) Date of Patent: Mar. 6, 2012

(54) ELECTRONIC DEVICE

(75) Inventor: Yuta Iizuka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 396 days.

(21) Appl. No.: 12/461,123

(22) Filed: Jul. 31, 2009

(65) Prior Publication Data

US 2010/0090910 A1 Apr. 15, 2010

(30) Foreign Application Priority Data

Oct. 9, 2008 (JP) ..... 2008-263198

(51) Int. Cl.
*H01Q 1/24* (2006.01)

(52) U.S. Cl. ..... 343/702

(58) Field of Classification Search ..... 343/702; 455/575.1, 575.3, 575.4, 575.7
See application file for complete search history.

(56) References Cited

U.S. PATENT DOCUMENTS

| | | | | |
|---|---|---|---|---|
| 7,118,410 | B2 | 10/2006 | Hatori | |
| 7,450,075 | B2 * | 11/2008 | Kim et al. | 343/702 |
| 2009/0033571 | A1 * | 2/2009 | Wang | 343/702 |

FOREIGN PATENT DOCUMENTS

| | | |
|---|---|---|
| JP | 5-18069 | 3/1993 |
| JP | 2005-151701 | 6/2005 |
| JP | 2006-111309 | 4/2006 |

* cited by examiner

*Primary Examiner* — Hoang V Nguyen
(74) *Attorney, Agent, or Firm* — Staas & Halsey LLP

(57) ABSTRACT

An electronic device includes a housing that has a rectangular plate section and a sidewall section provided with a control opening for slide control member provision, and an antenna housing groove extending in a longitudinal direction of the sidewall section; a protrusion that is provided upright at a point adjacent to one end of the antenna housing groove; a plate piece-like antenna unit that has a length to be completely housed in the antenna housing groove and including a radio communication antenna; a cable that is connected to the one end of the antenna unit and wound about the insertion hole, and that extends from the insertion hole further inward of the housing away from the antenna unit; and a cable guide member that holds the portion of the cable wound about the insertion hole between itself and the antenna unit.

10 Claims, 19 Drawing Sheets

ELECTRONIC DEVICE

CROSS-REFERENCE TO RELATED APPLICATION

This application is based upon and claims the benefit of priority of the prior Japanese Patent Application No. 2008-263198, filed on Oct. 9, 2008, the entire contents of which are incorporated herein by reference.

FIELD

The embodiments discussed herein are related to an electronic device including an antenna.

BACKGROUND

Recently, not only a mobile phone but also computers, such as a notebook personal computer (hereinafter, abbreviated as "notebook PC") and a so-called slate personal computer (hereinafter, abbreviated as "slate PC"), have each had an embedded antenna, whereby enabling data communications via radio waves. The slate PC has a rectangular plate-like shape, and includes a display screen fixed on its top surface. Meanwhile, there has been a strong demand to downsize and lighten these electronic devices such as the notebook PC, the slate PC and the mobile phone. On the other hand, there has been another strong demand to increase the size of a display screen that displays an image. To meet the latter demand, an electronic device is equipped with a display screen using a thin and lightweight liquid crystal panel or a display screen extending very close to the peripheral edge of the device's housing, and the like.

In this regard, an increasing number of electronic devices, such as notebook PCs and slate PCs as well as mobile phones, have each had an antenna embedded at a place such as beside the liquid crystal panel, and had radio communication functions. However, an electronic device may possibly be used at a location having an insufficient radio field intensity, and, accordingly, the antenna needs to be protruded from the device's housing. However, an antenna always protruded from the housing is obtrusive, and thus it is demanded that an antenna be normally housed in the housing, but can be protruded to the outside as needed.

Here, an antenna is connected to one end of a cable for connecting the antenna to a circuit. For a movable antenna which is normally housed in the housing, but is exposed to the outside as needed, some slack needs to be left in the cable so that the cable may not be pulled taut due to the movement of the antenna. In this case, however, assembly failure or breaking of the cable might be caused by accidents in fabricating the device such as that the slack cable is unintentionally caught between the housing and the cover member.

To avoid this, disclosed is a structure of a protector in which a disc-shaped adjusting member is provided in a main body at a position connected to an exit port for a branch wire of automobile wiring harness. The structure makes the length of the branch wire adjustable by winding the branch wire predetermined turns around the adjusting member (Japanese Laid-open Patent Publication No. 2005-151701).

Meanwhile, a structure provided with a guide around which power cord is to be wound is also disclosed. The structure allows power cord to be simply and reliably housed therein by neatly winding the cord about the guide (Japanese Unexamined Utility Model Application Publication No. 05-018069).

Moreover, a structure of a packaging member for an audio-visual device is also disclosed. The packaging member, which can be also used as a cord reel, is provided with a groove through which the cable is to be wound about the outer periphery of the packaging member (Japanese Laid-open Patent Publication No. 2006-111309).

SUMMARY

According to an aspect of the invention, an electronic device including:

a housing that has a rectangular plate section and a sidewall section provided upright on the plate section, and that houses electronic components therein, the sidewall section being provided with an antenna housing groove extending in a longitudinal direction of the sidewall section;

a protrusion that is provided upright at a point adjacent to one end of the antenna housing groove in the housing, the protrusion extending in a width direction of the antenna housing groove;

a plate piece-like antenna unit that has a length to be completely housed in the antenna housing groove and including a radio communication antenna, the antenna unit having, at one end, an insertion hole drilled through the antenna unit in a thickness direction thereof to allow the protrusion to be inserted therein, being housed in the antenna housing groove with the protrusion inserted in the insertion hole, and protruding from the housing by being rotated about the protrusion serving as a rotation shaft;

a cable that is connected to the one end of the antenna unit and wound about the insertion hole, and that extends from the insertion hole further inward of the housing away from the antenna unit; and a cable guide member that holds, between itself and the antenna unit, the portion of the cable wound about the insertion hole.

The electronic device disclosed herein has a structure in which the cable is arranged in a manner of being wound about the insertion hole and extending further inward of the housing therefrom, and in which the portion of the cable that is wound about the insertion hole is placed between the cable guide member and the antenna unit. Accordingly, the wound portion is kept in the condition where the cable is properly wound about the insertion hole, and thus assembly failure is prevented.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, an embodiment of the present invention will be described.

Figure 1:
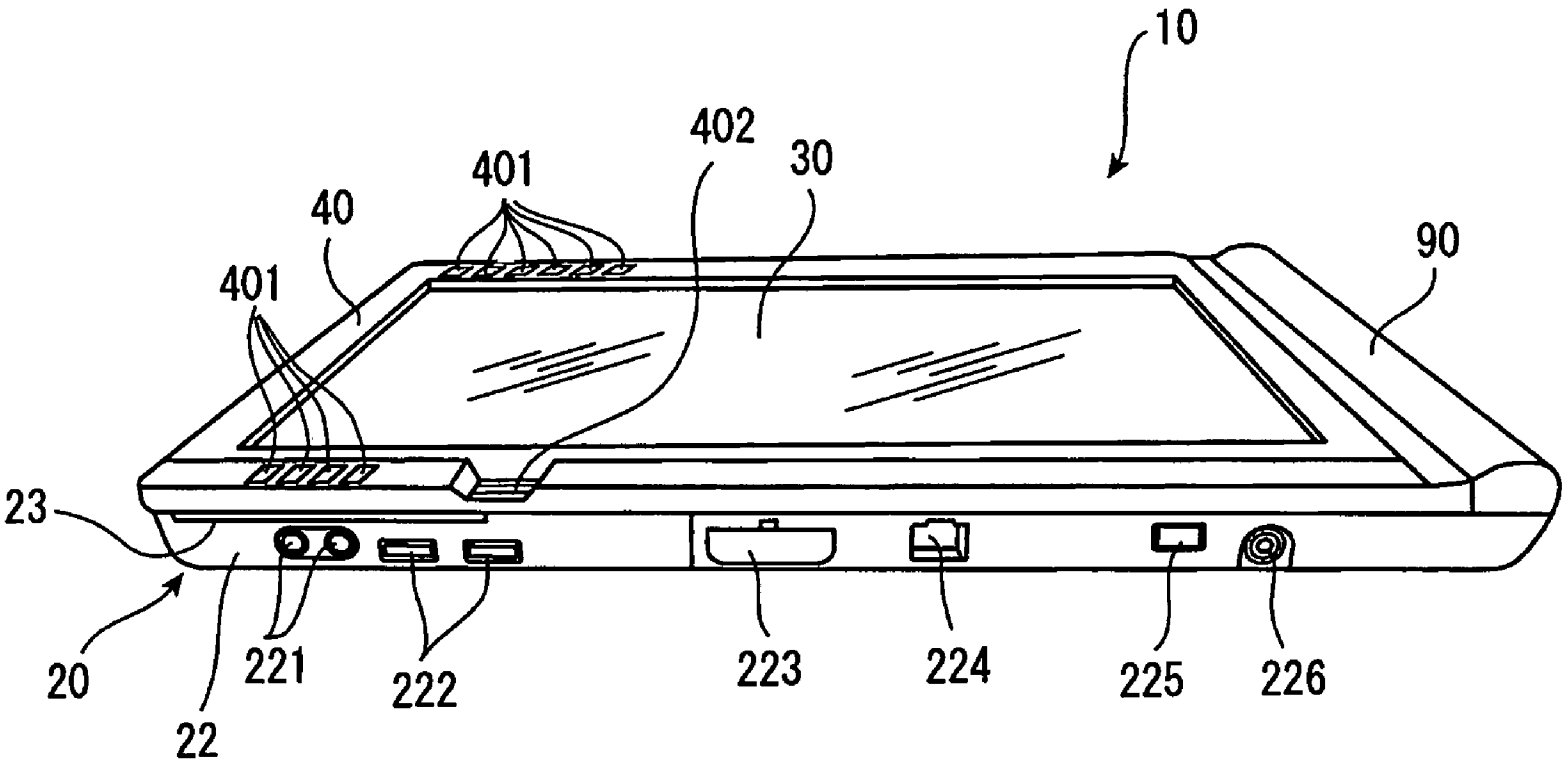
FIG. 1 is a perspective view illustrating a display screen side of a slate PC that is an embodiment of the present invention.
Figure 2:
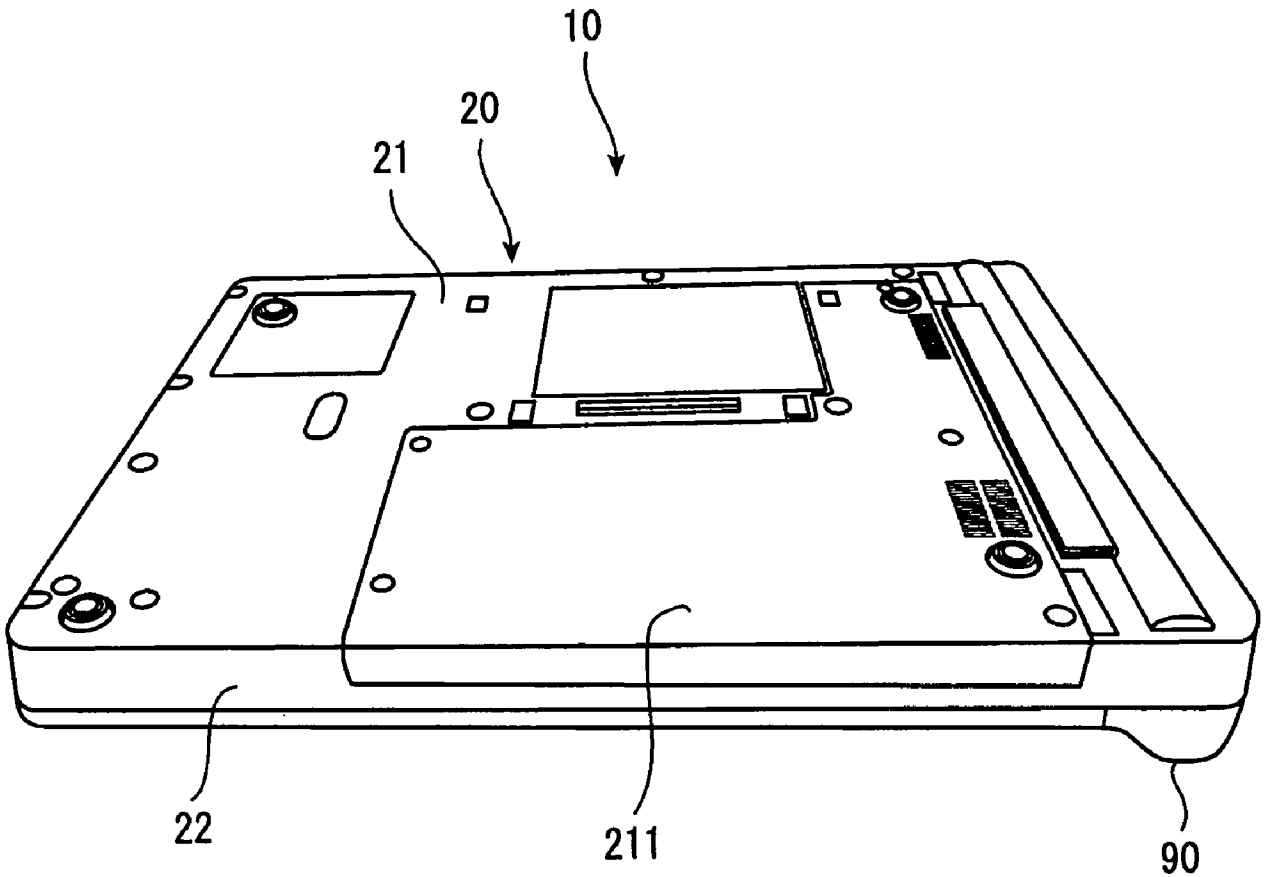
FIG. 2 is a perspective view illustrating a bottom side of the slate PC illustrated in FIG. 1.

FIG. 1 is a perspective view illustrating a display screen side of a slate PC that is an embodiment of the present invention. FIG. 2 is a perspective view illustrating a bottom side of the slate PC illustrated in FIG. 1.

A slate PC 10 illustrated in FIGS. 1 and 2 includes a housing 20, a display screen 30, and a cover member 40 having a frame-like shape surrounding the display screen 30. The cover member 40 in combination with the display screen 30 covers the housing 20.

As illustrated in FIG. 2, the housing 20 has a plate section 21 and a sidewall section 22. The plate section 21 having an approximately rectangular shape forms the bottom of the slate PC 10, while the sidewall section 22 is provided upright on the plate section 21.

As illustrated in FIG. 1, an antenna housing groove 23 extending in the longitudinal direction of the sidewall section 22 is formed in the sidewall section 22. The antenna housing groove 23 houses an antenna unit to be described later. In addition, the sidewall section 22 of the housing 20 is provided with an audio terminal 221, a USB terminal 222, a sound-output section 223 of a loudspeaker, a LAN terminal 224, a security slot 225 and a DC power terminal 226, which are component parts illustrated in FIG. 1. Meanwhile, as illustrated in FIG. 2, a cover 211 is screwed onto the plate section 21 of the housing 20. The cover 211 is provided to cover a hard disk drive (HDD) and a communication circuit housed in the housing 20. The cover member 40 illustrated in FIG. 1 is provided with various switches 401 and a fingerprint sensor 402. Additionally, a battery 90 is installed in the slate PC 10.

Figure 3:
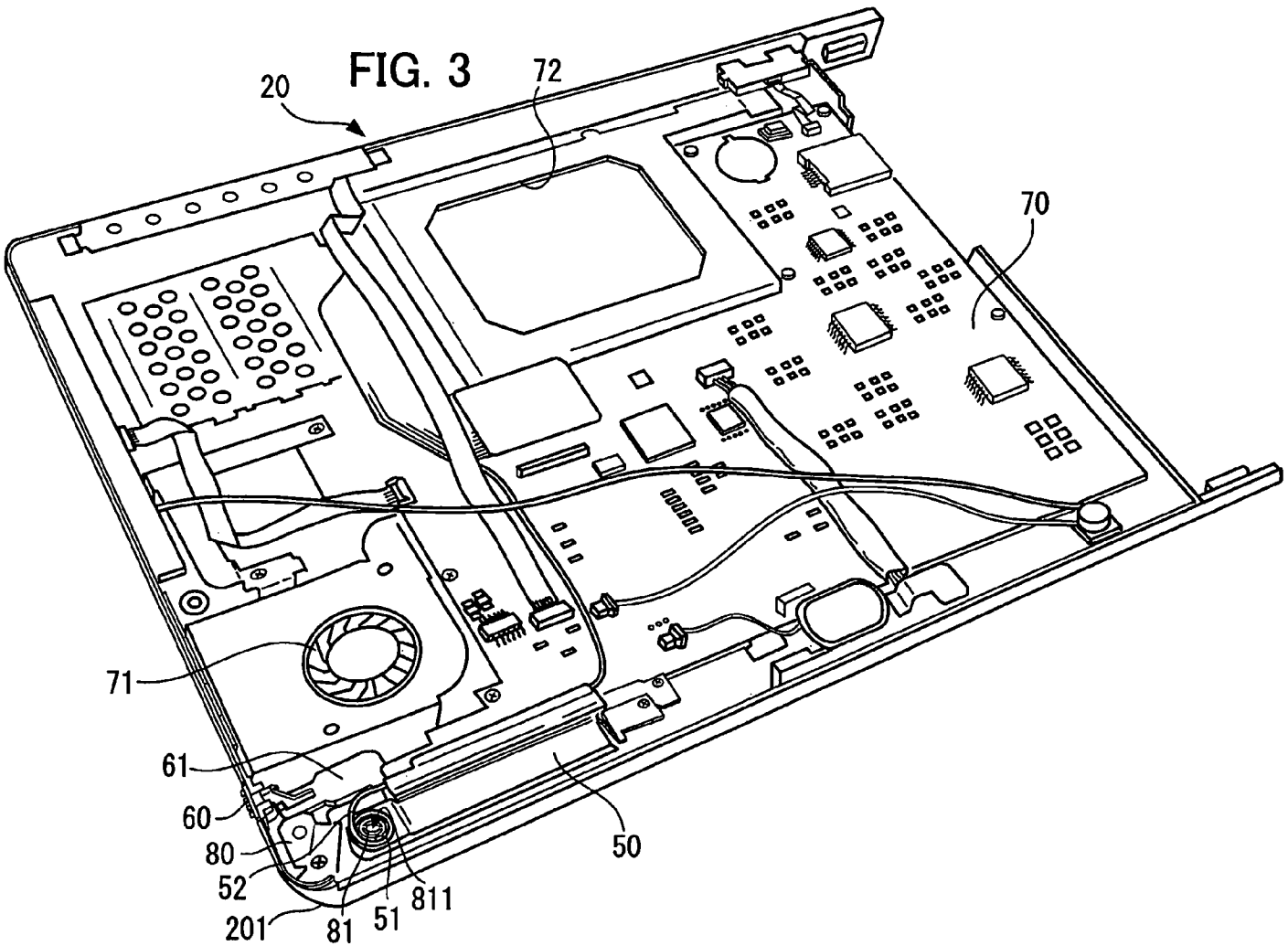
FIG. 3 is a perspective view illustrating the inside of housing.

FIG. 3 is a perspective view illustrating the inside of the housing 20.

FIG. 3 illustrates an antenna unit 50, a control member 60 and a lever member 61, all of which are feature components in this embodiment. The antenna unit 50, which has a plate piece-like shape, is designed to be pushed out by using the control member 60 and the lever member 61. A detailed description thereof will be given later. In addition, FIG. 3 also illustrates that a main board 70, an air-cooling fan 71 and the like are placed in the housing 20. Various circuit components for performing arithmetic processing are mounted on the main board 70. The HDD (not illustrated) is to be placed into an opening 72 illustrated in FIG. 3 from the bottom side illustrated in FIG. 4.

An insertion hole 51 is formed at one end of the antenna unit 50. The insertion hole 51 is drilled through the antenna unit 50 in its thickness direction to allow a protrusion 81 to be inserted therein. A fitting 80 having the protrusion 81 formed thereon is provided in the housing 20. The protrusion 81 is inserted in the insertion hole 51 to serve as a rotation shaft, and the antenna unit 50 rotates between a housed position and a protruding position. Here, in the housed position, the antenna unit 50 is housed in the housing 20 as illustrated in FIG. 3, whereas in the protruding position, the antenna unit 50 protrudes from the housing 20 as will be described later.

In addition, one end of a cable 52 is connected to the one end of the antenna unit 50 at which the insertion hole 51 is formed. The cable 52 is wound about the insertion hole 51, and extends further inward of the housing 20 therefrom. Here, the cable 52 is wound about the insertion hole 51 in such a direction that the wound portion of the cable 52 may come loose as the antenna unit 50 rotates from the housed position to the protruding position. Moreover, though removed in FIG. 3, a cable guide member is placed on the portion of the cable 52 that is wound about the insertion hole 51, and screwed onto the protrusion 81 with a screw hole 811 formed in the protrusion 81. The cable guide member will be described in detail later.

Meanwhile, the control member 60, which is a sliding control member, is designed to be slid toward a corner 201 of the housing 20. The fact that this sliding direction is approximately parallel to the protruding direction of the antenna unit 50 enables intuitive control of the antenna unit 50. When the control member 60 is slid toward the corner 201 of the housing 20, the slide is transferred to the lever member 61. In response, the lever member 61 pushes to slightly rotate the antenna unit 50 being in the housed position. Once the antenna unit 50 partially comes out of the housing 20 as a result of this slight rotation, the antenna unit 50 can be rotated to the protruding position with the fingers.

Figure 4:
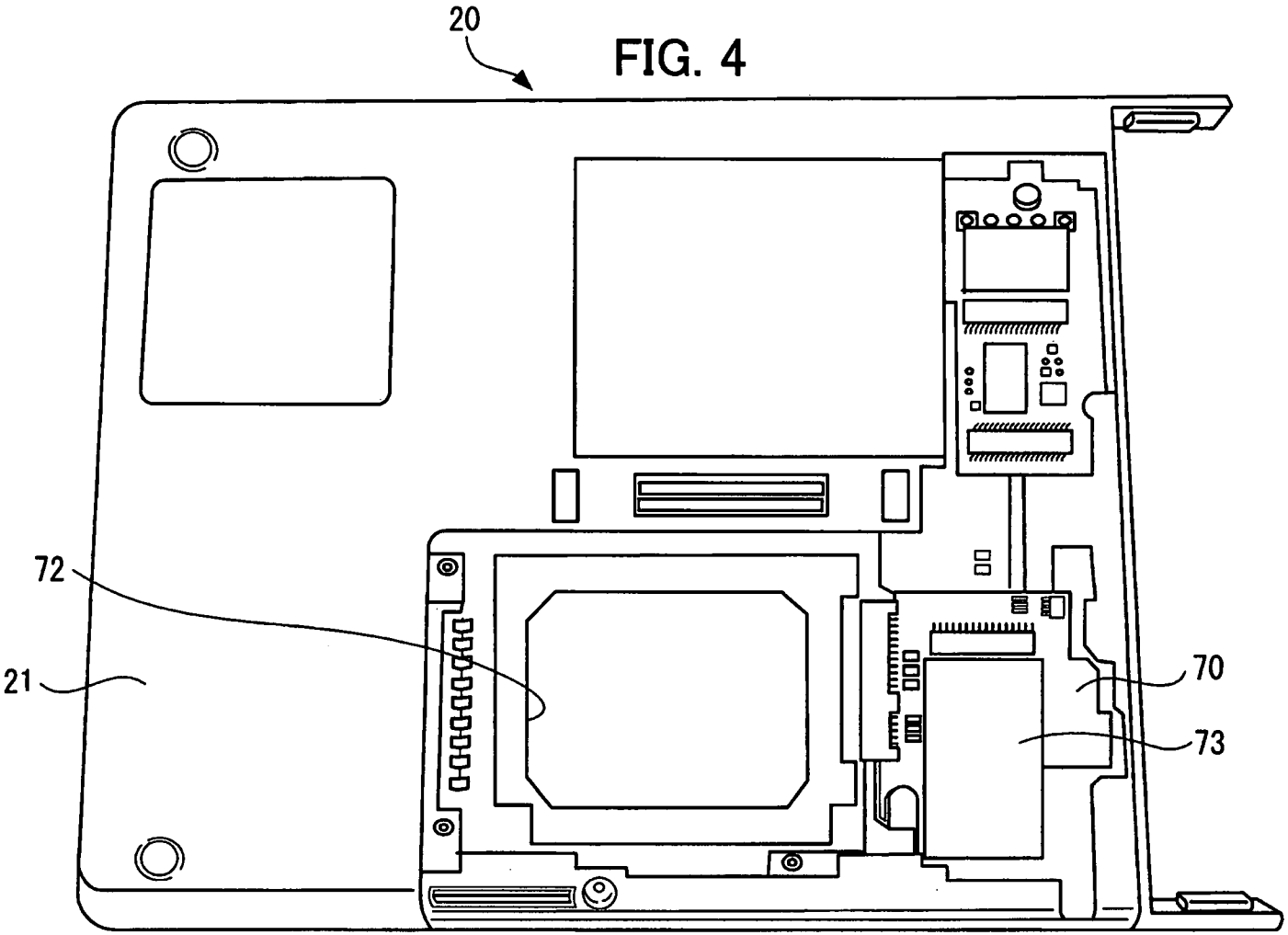
FIG. 4 is a perspective view illustrating the back side of the housing of the slate PC disassembled to the state illustrated in FIG. 3.

FIG. 4 is a perspective view illustrating the back side of the housing 20 of the slate PC 10 disassembled to the state illustrated in FIG. 3.

FIG. 4 illustrates the opening 72, which is also illustrated in FIG. 3. The HDD (not illustrated) is to be placed in the opening 72 by using a portion around the opening 72 as a base. A communication module 73 mounted on the main board 70 is illustrated adjacent to the opening 72. The cable 52 illustrated in FIG. 3 connects the antenna unit 50 to the communication module 73.

Figure 5:
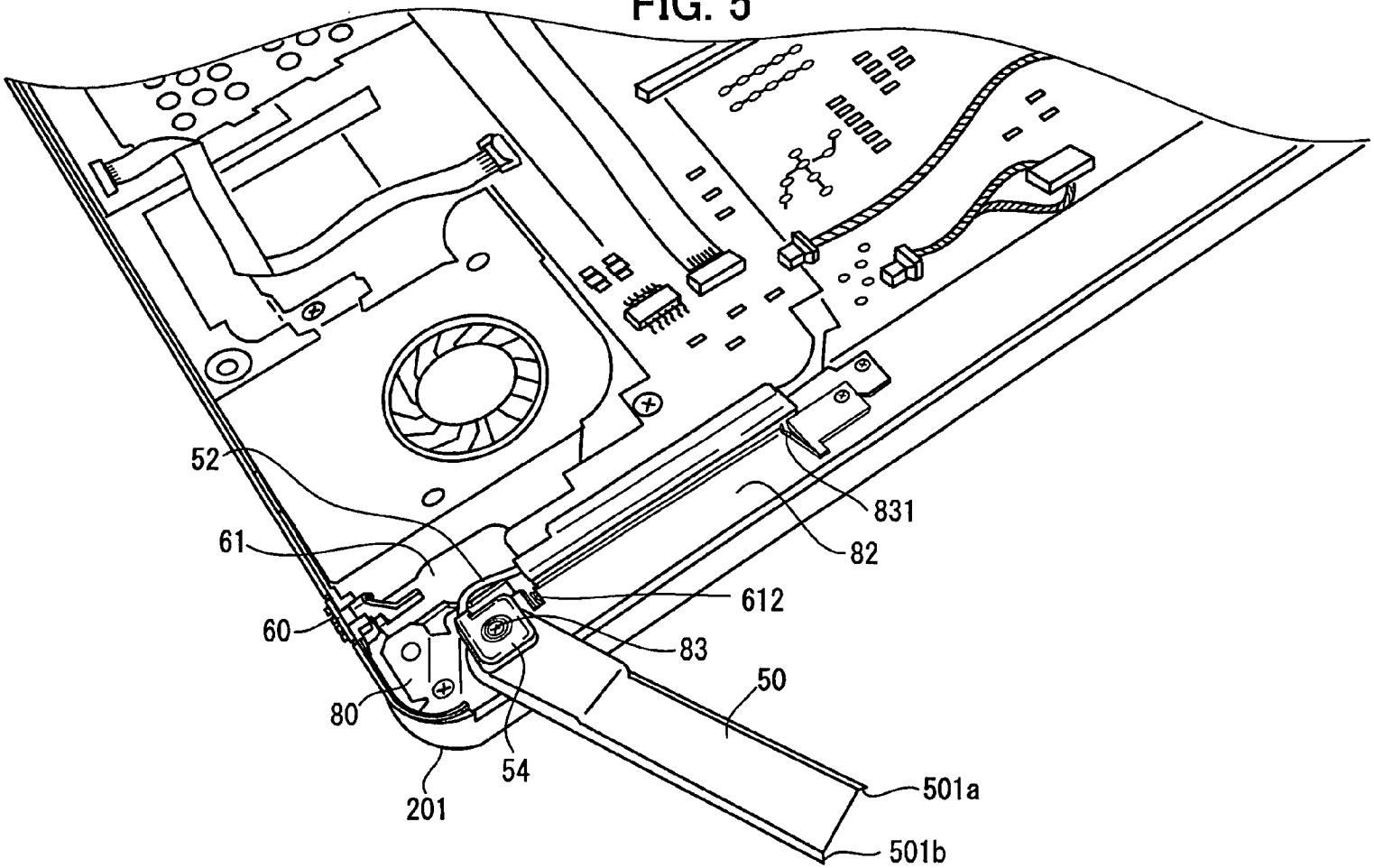
FIG. 5 is a perspective view illustrating a state where an antenna unit is half-rotated.

FIG. 5 is a perspective view illustrating a state where the antenna unit 50 is half-rotated.

In addition to the fitting 80 having the protrusion 81 (see FIG. 3) formed thereon, FIG. 5 illustrates another fitting 82. The fitting 82 not only functions as a base of the antenna unit 50 in the housed position, but also functions, when the antenna unit 50 is in the protruding position, as a screen that prevents the inside of the housing 20 from being viewed from the antenna housing groove 23. As illustrated in FIG. 5, the antenna unit 50 has projections 501*a* and 501*b* at its outer end, and the projection 501*a* at one corner of the outer end is locked to a cantilever locking part 831 when the antenna unit 50 is in the housed position. When pushed as will be described later, the antenna unit 50 gets unlocked from the locking part 831, and slightly rotates in the direction to protrude from the housing 20. As a result, the projection 501*b* at the other corner of the outer end comes out of the housing 20. After that, the antenna unit 50 can further be pulled out to the protruding position with the fingers put on the projection 501*b*. In this embodiment, the antenna unit 50 reaches the protruding position by rotating 120 degree from the housed position.

Moreover, FIG. 5 also illustrates a cable guide member 54. As described above, the cable guide member 54 has a function of holding the portion of the cable 52 that is wound about the insertion hole 51 (see FIG. 3) of the antenna unit 50.

Hereinafter, a detailed description will be given of the cable guide member 54.

Figure 6:
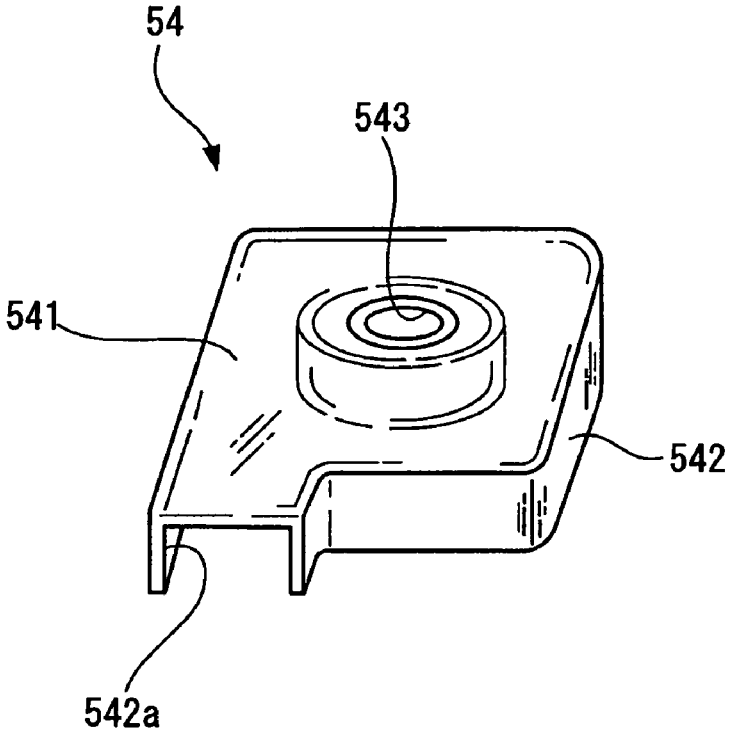
FIG. 6 is a perspective view illustrating a cable guide member alone.
Figure 7:
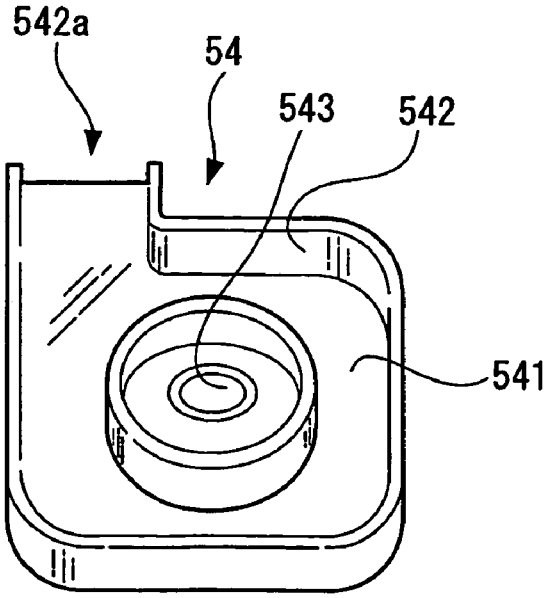
FIG. 7 is an upside-down perspective view of the cable guide member.
Figure 8:
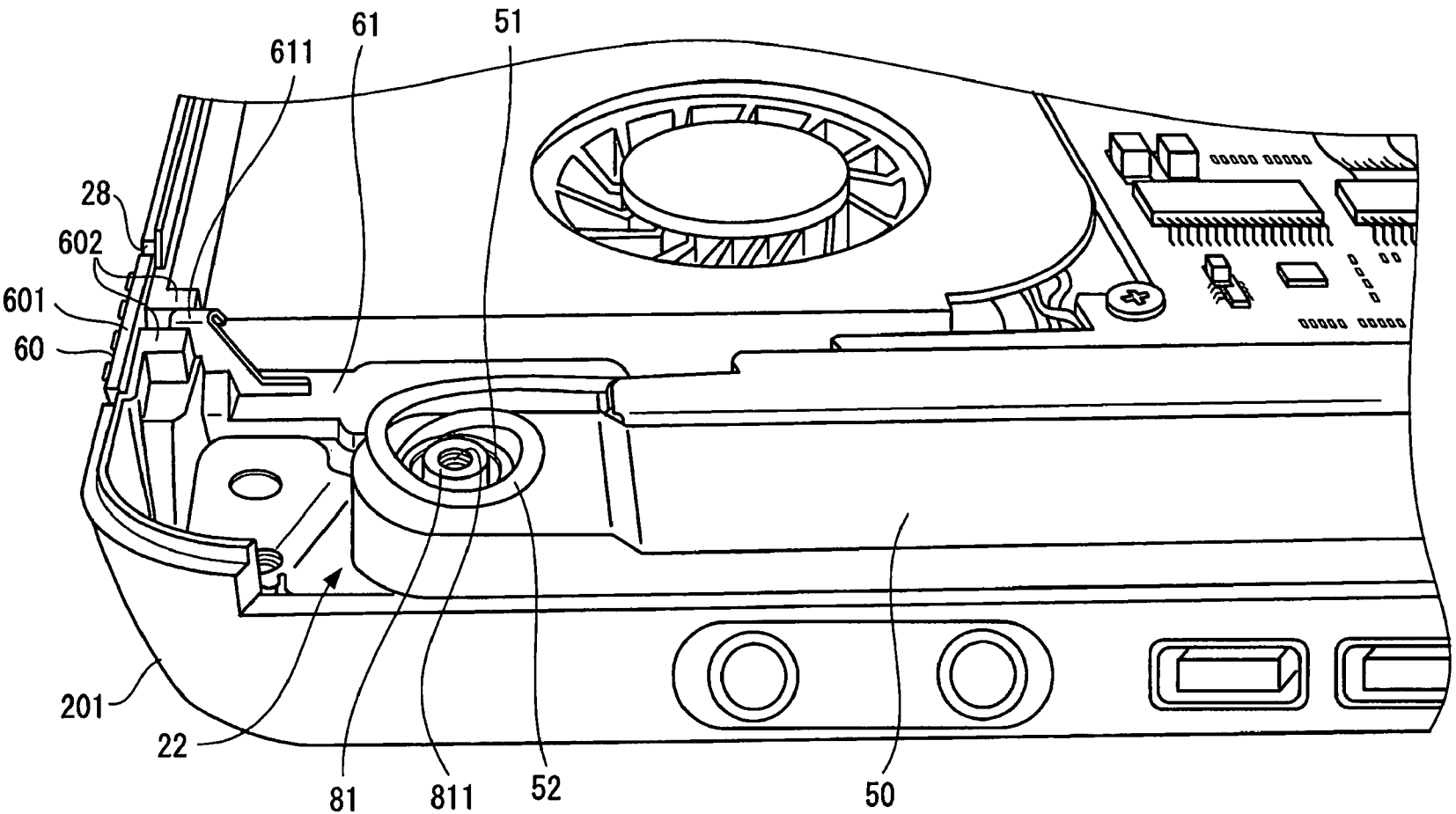
FIG. 8 is a perspective view illustrating a region including an insertion hole of the antenna unit with the cable guide member removed.
Figure 9:
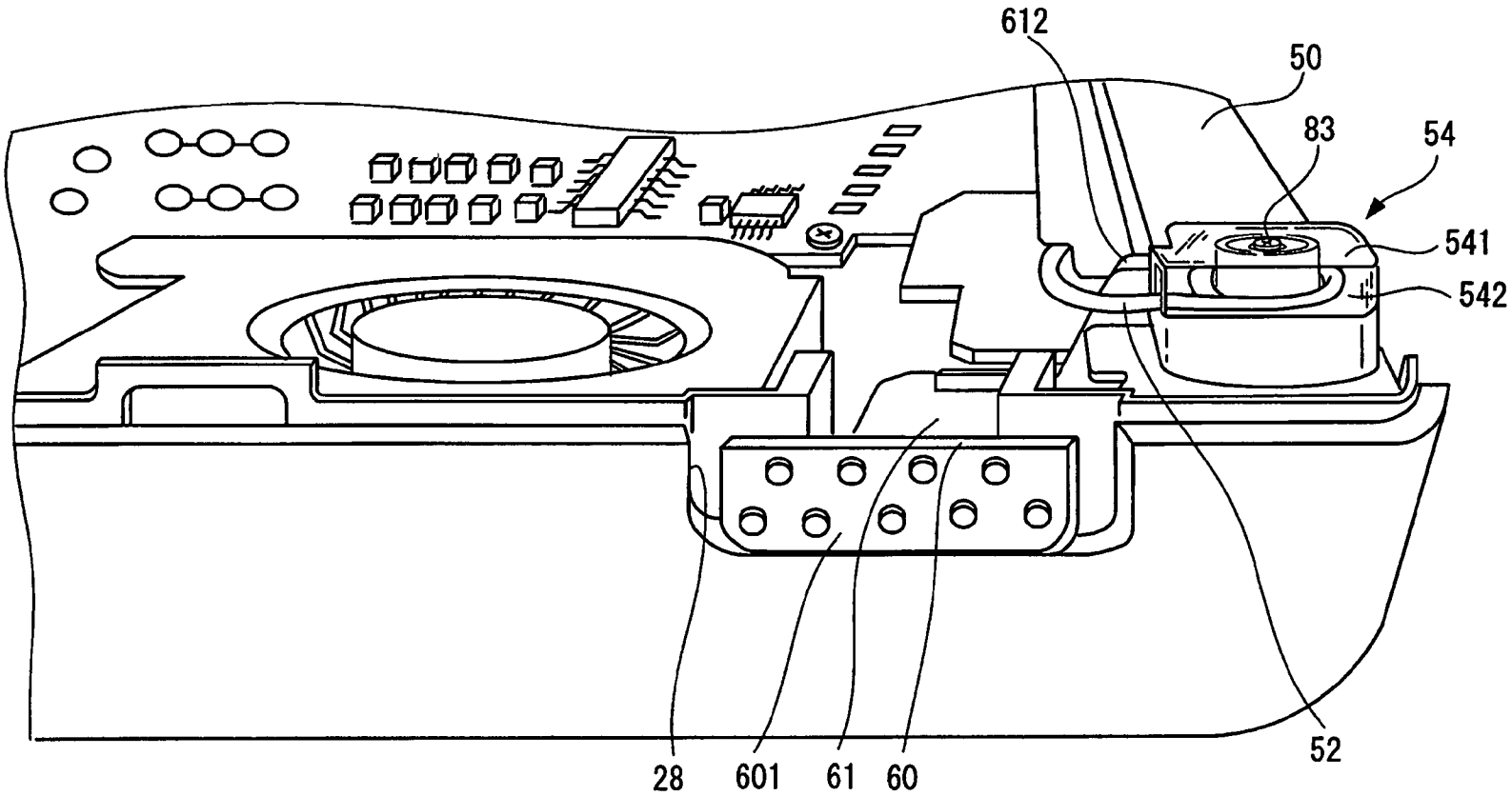
FIG. 9 is a perspective view illustrating the region with the cable guide member fixed.

FIG. 6 is a perspective view illustrating the cable guide member 54 alone, and FIG. 7 is an upside-down perspective view of the cable guide member 54. FIG. 8 is a perspective view illustrating a region including the insertion hole 51 of the antenna unit 50 with the cable guide member 54 removed. FIG. 9 is a perspective view illustrating the region with the cable guide member 54 fixed.

The cable guide member 54 is made of a transparent resin through which the cable 52 is visible, and has a plate section 541 and a sidewall section 542. The plate section 541 has a function of holding, between itself and the antenna unit 50, the portion of the cable 52 that is wound about the insertion hole 51 of the antenna unit 50. Meanwhile, the sidewall section 542, provided upright from the peripheral edge of the plate section 541 toward the antenna unit 50, has a function of surrounding the portion of the cable 52 that is wound about the insertion hole 51. The sidewall section 542 includes an opening 542*a* formed to allow the cable 52 to extend to the outside of the cable guide member 54. In addition, the cable guide member 54 is provided with a mounting hole 543 formed at the center thereof. As illustrated in FIG. 9, the cable guide member 54 is fixed to the protrusion 81 with a screw member 83 fastened in the screw hole 811 of the protrusion 81 after being inserted into the mounting hole 543.

Conditions of the cable 52 are visible even after the cable guide member 54 is placed thereon since the cable guide member 54 is formed of a transparent resin. This allows proper holding of the cable 52. After the cable guide member 54 is placed on the cable 52 and fixed with the screw member 83, the cover member 40 illustrated in FIG. 1 is placed on and fixed to the housing 20. At the time of fixing the cover member 40, too, the transparency of the cable guide member 54 makes it possible to prevent the cable 52 from being unintentionally caught between the housing 20 and the cover member 40. Thus, assembly failure or breaking of the cable 52 caused by this accident can also be prevented.

Next, a description will be given of a structure for pushing out the antenna unit 50 in the housed position, with reference to FIGS. 8 and 9, again.

The sidewall section 22 of the housing 20 is provided with a control opening 28 formed in one of four sidewall parts of the sidewall section 22. At the corner 201, this sidewall part is in contact with the sidewall part in which the antenna housing groove 23 is formed. The control member 60 is placed to extend across the inside and outside of the housing 20 through the control opening 28. The control member 60 has a control piece 601 and two arm sections 602. The control piece 601, placed at the outside of the sidewall section 22 of the housing 20, is designed to be slid by the human fingers. The arm sections 602 extend like a fork from the control piece 601 to the inward of the housing 20 through the control opening 28. These two arm sections 602 hold therebetween an engaging section 611 of the lever member 61 formed at its one end in contact with the control member 60. The lever member 61 has a rotation shaft extending horizontally in the housing 20, namely, extending perpendicular to a plane where the control piece 601 lies. Accordingly, when the control piece 601 is slid toward the corner 201 of the housing 20, the arm section 602 moves in this direction, so that the engaging section 611 of the lever member 61 tilts toward the corner 201. In response, a working section 612 of the lever member 61 also tilts toward the antenna unit 50. Here, the working section 612 is formed at the end of the lever member 61 opposite to the end where the engaging section 611 is formed. As a result, the working section 612 pushes the antenna unit 50 at a point slightly closer, than the insertion hole 51, to the end opposite to the end where the insertion hole 51 is formed (see FIG. 3, for example). As described above, the antenna unit 50 has the projections 501*a* and 501*b* (see FIG. 5) respectively at both corners of the outer end. The projection 501*a* at one corner is locked to the cantilever locking part 831 when the antenna unit 50 is in the housed position. However, when pushed, the antenna unit 50 gets unlocked from the locking part 831, and slightly rotates in the direction to protrude from the housing 20. After that, the antenna unit 50 can further be pulled out with the nails put on the projection 501*b* at the other corner of the outer end.

As described above, the slide of the control member 60 is converted into the rotation of the lever member 61, whereby the antenna unit 50 is pushed out in this embodiment. This allows provision of the control member 60 at a position away from the antenna unit 50. For example, the antenna housing groove 23 and the control opening 28 may be provided in different sidewall parts of the sidewall section 22 as in this embodiment. Moreover, though the control member 60 is arranged at a position away from the antenna unit 50, this embodiment can still provide good operability.

Figure 10:
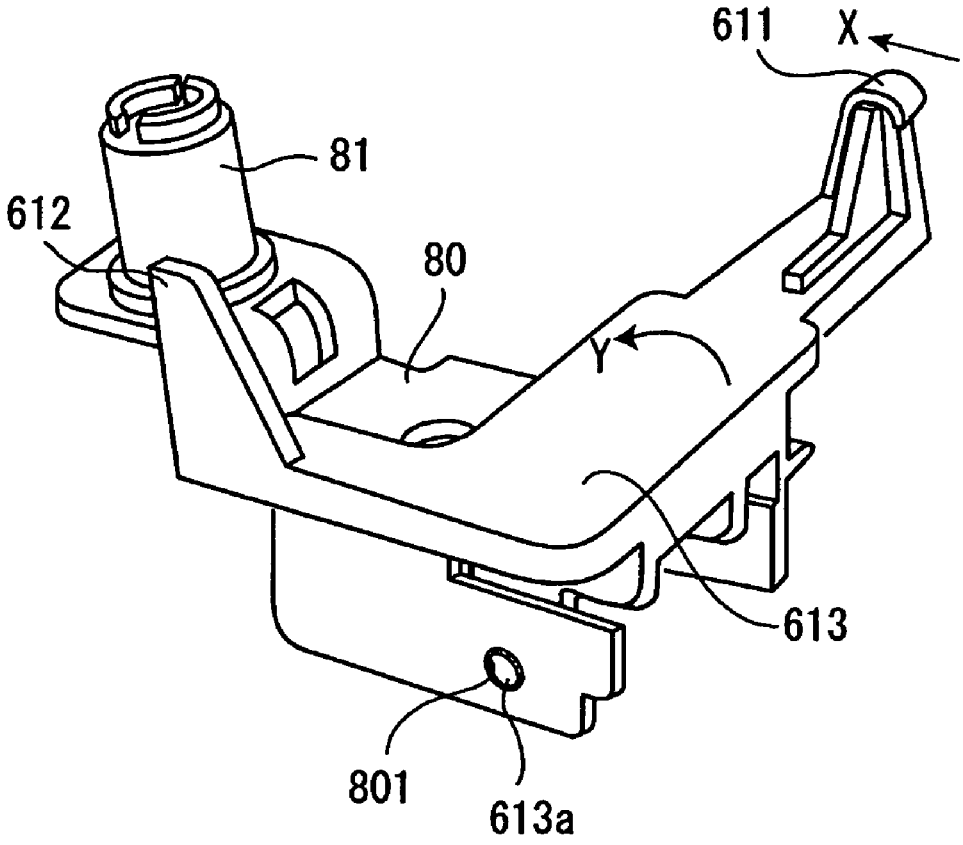
FIG. 10 is a perspective view illustrating an assembled state of a lever member and a fitting having a protrusion.
Figure 11:
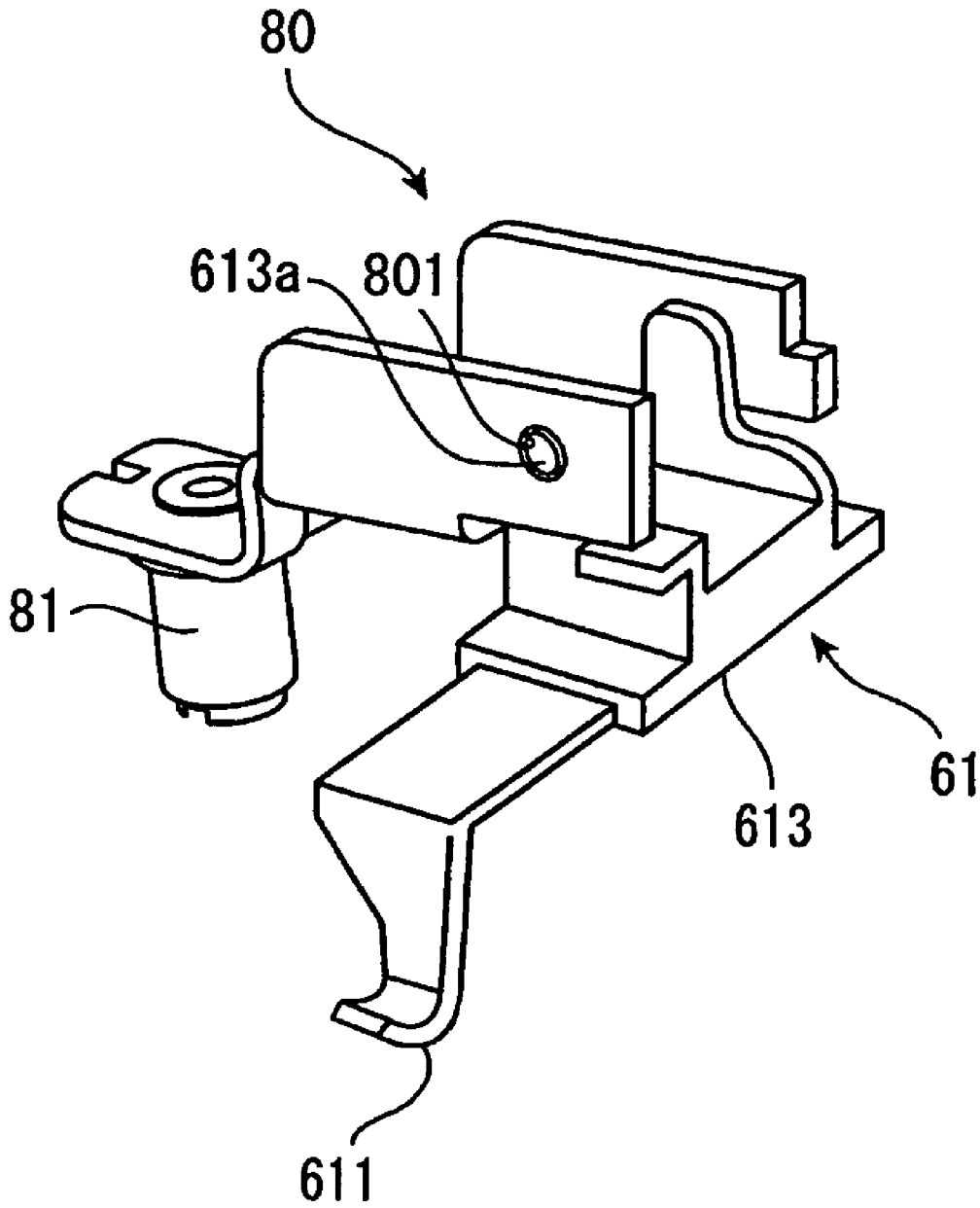
FIG. 11 is an upside-down perspective view of the assembled state illustrated in FIG. 10.

FIG. 10 is a perspective view illustrating an assembled state of the lever member 61 and the fitting 80 having the protrusion 81. FIG. 11 is an upside-down perspective view of the assembled state illustrated in FIG. 10.

As described above, the protrusion 81 of the fitting 80 is inserted in the insertion hole 51 of the antenna unit 50 (see FIG. 8, for example), thus serving as the rotation shaft of the antenna unit 50. In addition, the fitting 80 has a hole 801 to which a pin 613*a* is to be inserted. The pin 613*a* serves as a rotation center of the lever member 61.

The lever member 61 has: a base 613 including the pin 613*a* to serve as the rotation center; and the engaging section 611 and the working section 612 each of which is provided upright on the base 613. Specifically, the engaging section 611 is provided on the side facing the control member 60 (see FIGS. 8 and 9), while the working section 612 is provided on the side facing the antenna unit 50 (see FIGS. 8 and 9).

As illustrated in FIG. 8, the engaging section 611 is held between the two arm sections 602 of the control member 60. When the control member 60 is slid in the direction indicated by the arrow X, the lever member 61 rotates about the pin 613*a* that is inserted in the hole 801 of the fitting 80 in the direction indicated by the arrow Y. The rotation causes the working section 612 of the lever member 61 to push the antenna unit 50 in which the protrusion 81 is inserted. As a result, the antenna unit 50 slightly rotates, and thus the outer end of the antenna unit 50 partially comes out of the housing 20. After that, the antenna unit 50 can further be pulled out with the nails put thereon.

Figure 12:
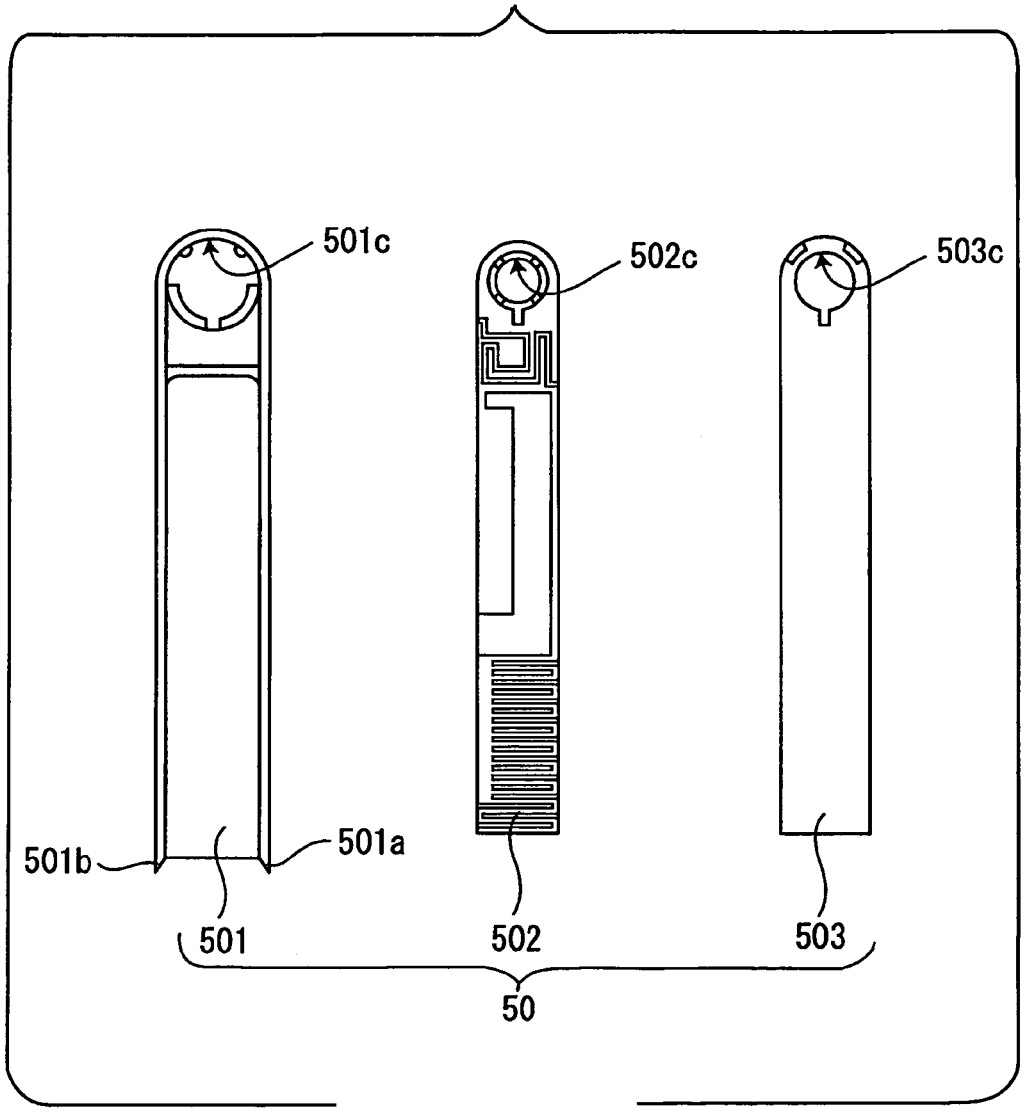
FIG. 12 is an exploded view of the antenna unit.

FIG. 12 is an exploded view of the antenna unit 50.

The antenna unit 50 is formed of a bottom cover 501, an antenna 502 and a top cover 503. A through hole 501*c* is formed at one end of the bottom cover 501. Through holes 502*c* and 503*c* are respectively formed in the antenna 502 and the top cover 503 at positions corresponding to the through hole 501*c* of the bottom cover 501. In addition, the bottom cover 501 has the projections 501*a* and 501*b* respectively at both the corners of the end opposite to the end in which the through hole 501*c* is formed. The antenna unit 50 is fabricated by fitting the antenna 502 into the bottom cover 501, and then attaching the top cover 503 thereon. The bottom cover 501 and the top cover 503 are made of a flexible material such as an elastomer, a rubber (a nitrile butadiene rubber (NBR), silicon rubber or chloroprene rubber (CR)), polyethylene terephthalate (PET) or polycarbonate (PC). The antenna 502 may be an antenna of any type such as a flexible printed circuit (FPC) antenna, a circuit board antenna or a sheet-metal antenna.

Figure 13:
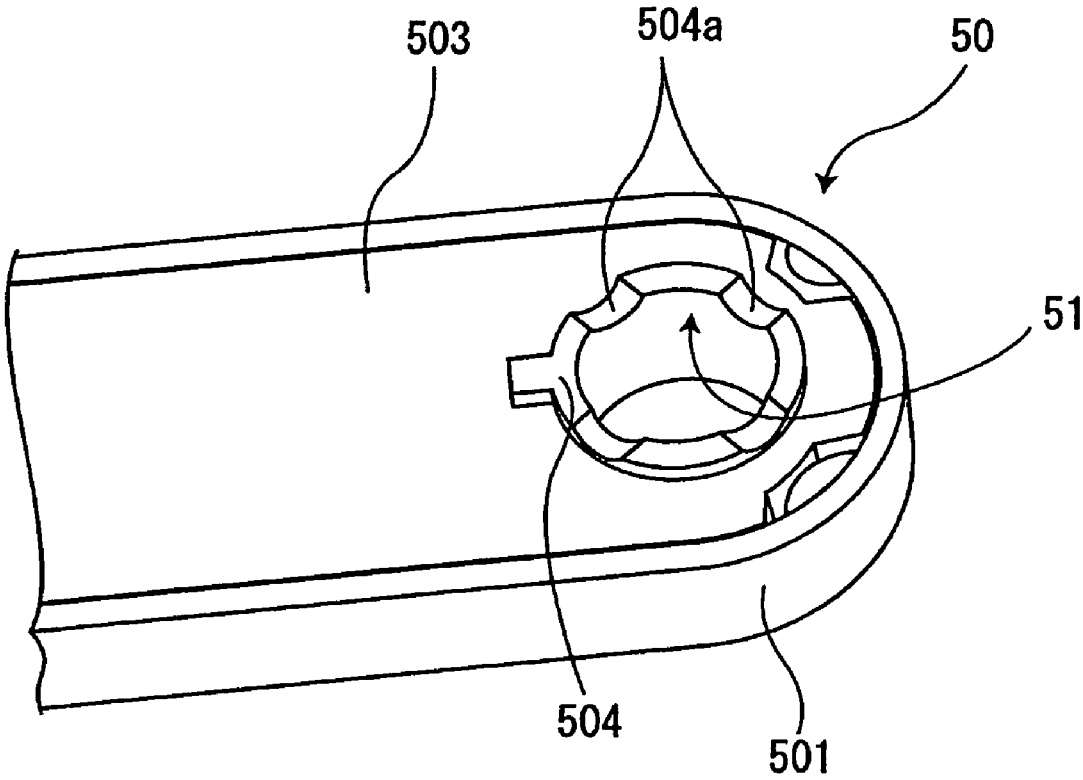
FIG. 13 is a perspective view of a rotation center portion of the fabricated antenna unit when viewed from the top cover side.

FIG. 13 is a perspective view of a rotation center portion of the fabricated antenna unit 50 when viewed from the top cover side.

As illustrated in FIG. 13, in the antenna unit 50, formed are the insertion hole 51 made of the three through holes 501*c*, 502*c* and 503*c* illustrated in FIG. 12. The peripheral edge of the insertion hole 51 is formed of a bearing member 504 in which four recesses 504*a* are formed surrounding the insertion hole 51.

Note that the antenna unit 50 illustrated in FIG. 13 is turned upside down. Actually, the protrusion 81 (see FIG. 10, for example) is inserted in the insertion hole 51 with the recesses 504*a* of the bearing member 504 facing down.

Figure 14:
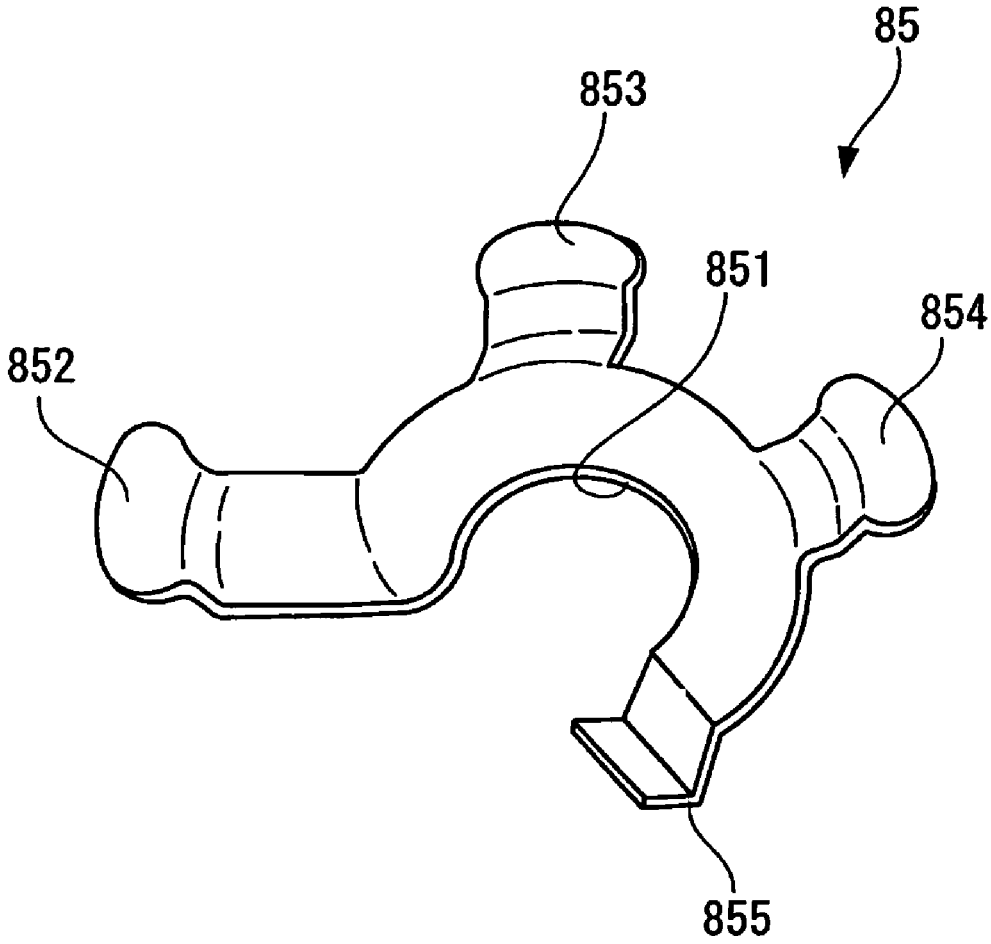
FIG. 14 is a perspective view of a locking member.

FIG. 14 is a perspective view of a locking member.

The protrusion 81 (see FIG. 10, for example), which is to be inserted to the insertion hole 51 of the antenna unit 50, is inserted to the locking member 85 before inserted to the antenna unit 50. Accordingly, the locking member 85 is placed between the fitting 80 and the antenna unit 50. The locking member 85 is used to hold the antenna unit 50 in the protruding position after the antenna unit 50 moves to the protruding position. The locking member 85 has an opening 851 into which the protrusion 81 is to be inserted, at its center, as well as three legs 852, 853 and 854 and a locking protrusion 855 at its periphery. The locking member 85, which is illustrated upside down in FIG. 14, is designed to allow the protrusion 81 to be inserted therein, and supported by its own legs 852, 853 and 854. The bearing member 504 of the antenna unit 50 is to be placed on the locking member 85.

Once the antenna unit 50 rotates to the protruding position, the locking protrusion 855 of the locking member 85 is inserted into one of the recesses 504*a* (see FIG. 13) of the bearing member 504 of the antenna unit 50. This not only ensures stable fixing of the antenna unit 50 in the protruding position, but also allows, when the antenna unit 50 is pushed in the direction of the housed position, the antenna unit 50 to be unlocked from the locking protrusion 855, thus being free to rotate.

Figure 15:
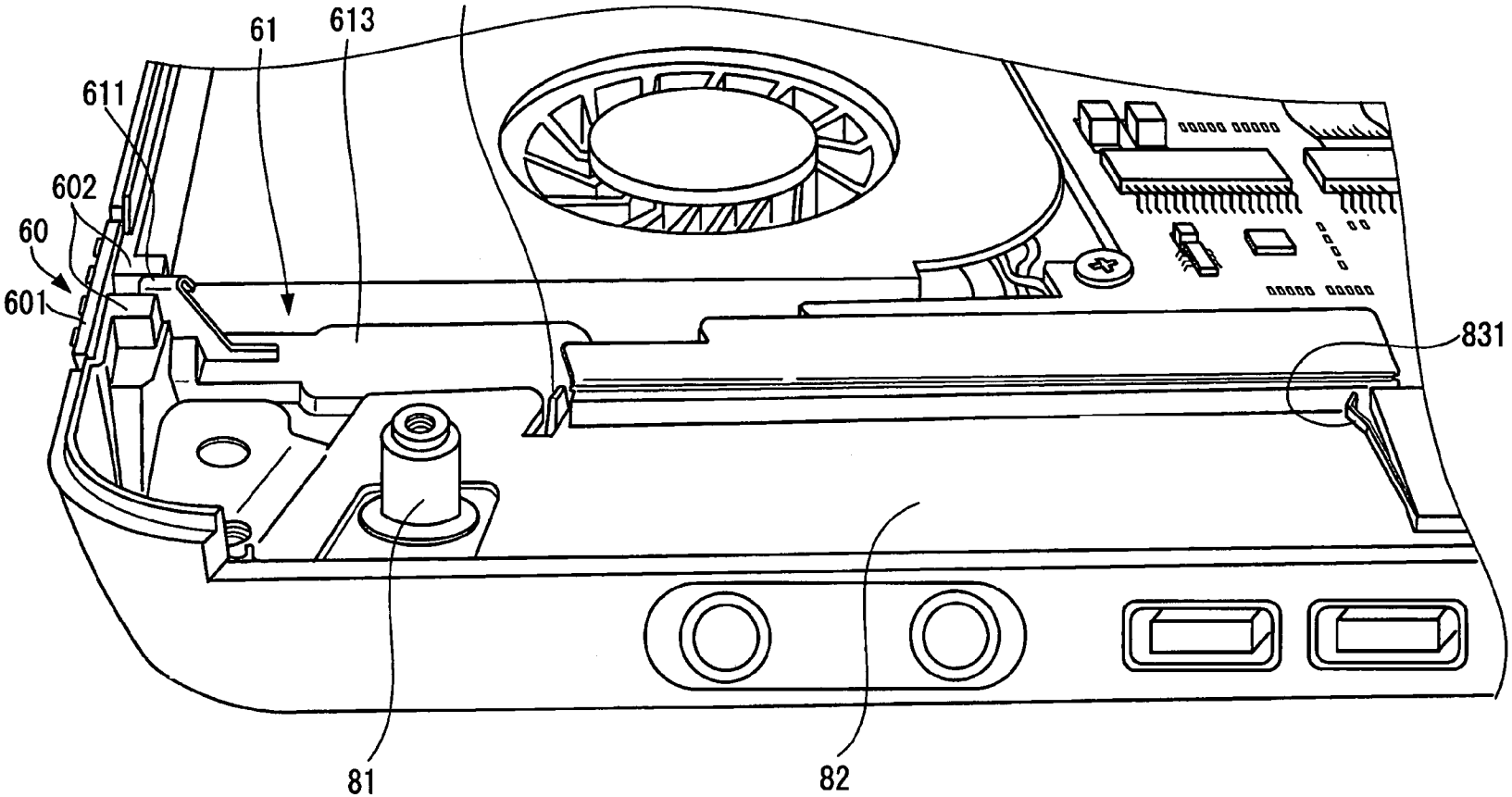
FIG. 15 is a perspective view of the inside of an antenna housing groove with the antenna unit removed.

FIG. 15 is a perspective view of the inside of the antenna housing groove 23 with the antenna unit 50 removed.

As described with reference to FIG. 5, the antenna unit 50, which rotates about the protrusion 81 inserted therein, is placed on the fitting 82 when being in the housed position. In this housed position, the projection 501*a* (see FIG. 12) at one corner of the outer end of the antenna unit 50 is locked to the cantilever locking part 831, so that the antenna unit 50 is stably held in the housed position.

Figure 16:
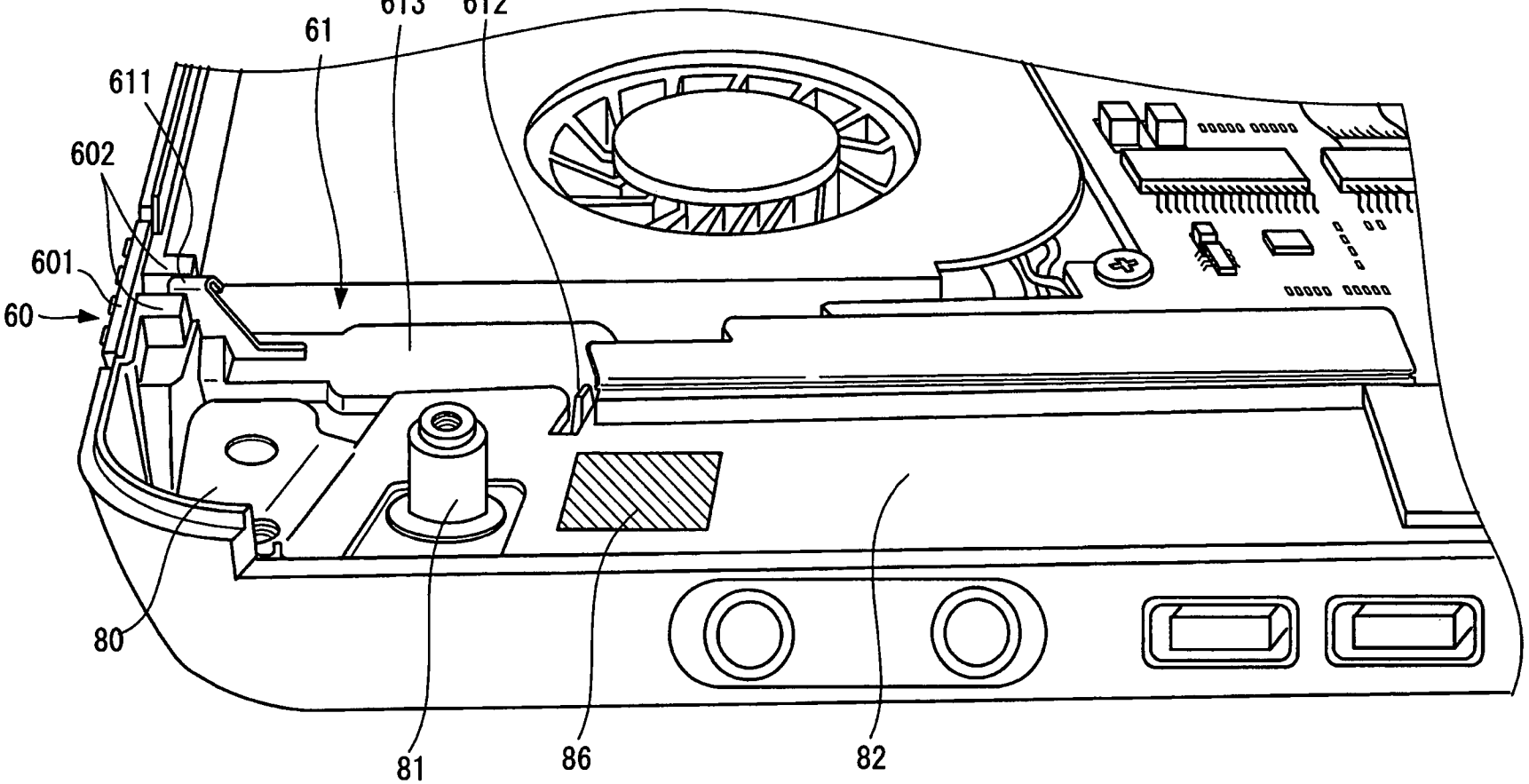
FIG. 16 is a perspective view illustrating modification of the internal structure of the antenna housing groove.

FIG. 16 is a perspective view illustrating modification of the internal structure of the antenna housing groove 23.

In this modification, the locking part 831 illustrated in FIG. 15 is not provided, and a sheet member 86 is stuck on the fitting 82 instead. The sheet member 86 has a function of stably holding the antenna unit 50 in the housed position by causing friction with the antenna unit 50 being in the housed position.

Providing the sheet member 86 instead of the locking part 831 illustrated in FIG. 15 can also stably hold the antenna unit 50 in the housed position, thus preventing unintentional rotation thereof.

Next, a description will be given of a second embodiment of the cable guide member.

Figure 17:
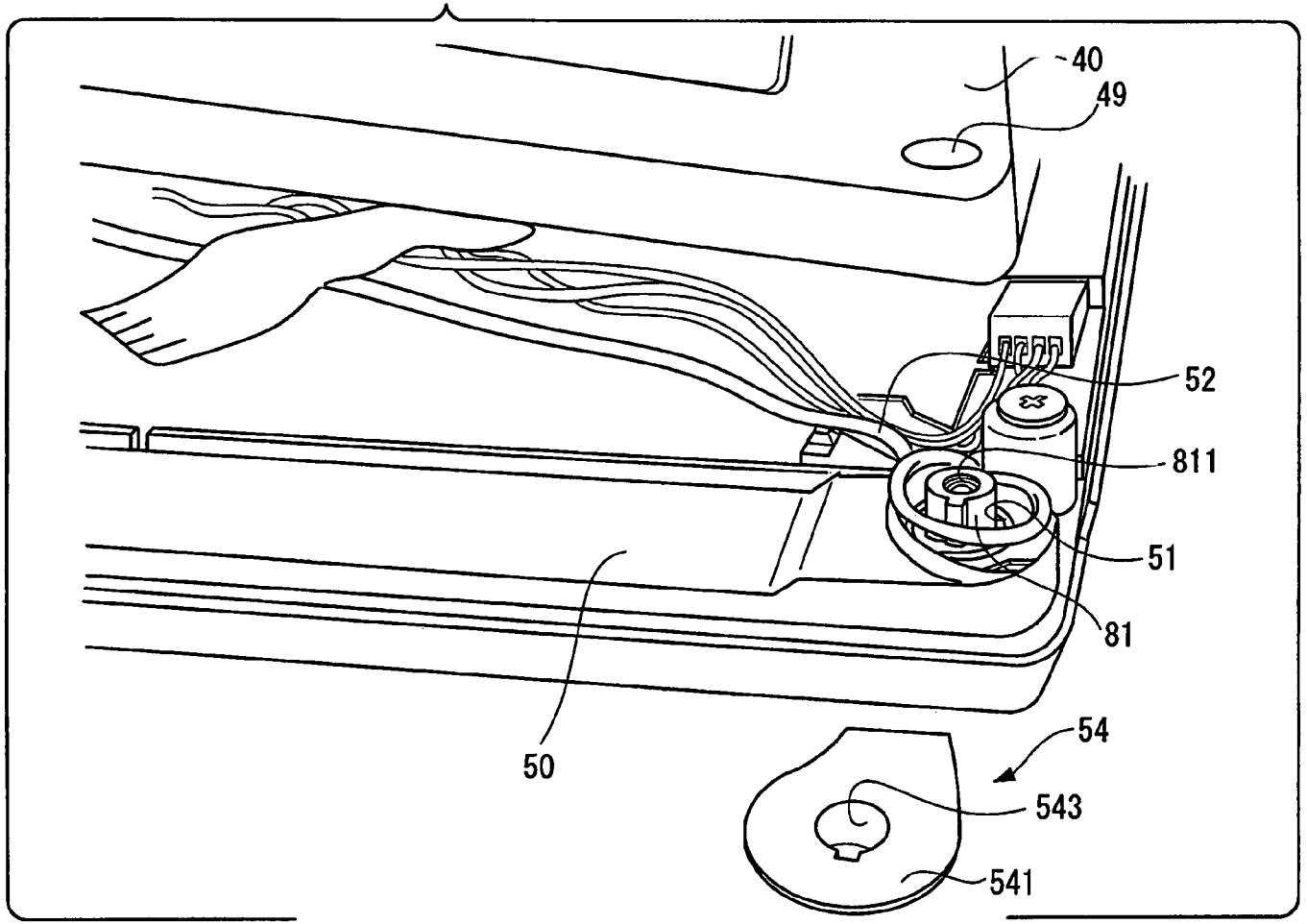
FIG. 17 illustrates an antenna unit housed in the antenna housing groove, and a cable guide member removed therefrom.

FIG. 17 illustrates an antenna unit housed in an antenna housing groove, and a cable guide member removed therefrom. For ease of understanding, the same elements in FIG. 17 and the subsequent drawings as those in the above drawings are denoted by the same reference numerals even if any of them differs from the corresponding element in a shape or the like.

The antenna unit 50 is housed with the protrusion 81 inserted in the insertion hole 51 formed at one end of the antenna unit 50. One end of the cable 52 is connected to the one end, where the insertion hole 51 is formed, of the antenna unit 50. The cable 52 is wound about the insertion hole 51, and extends further inward of the housing 20 therefrom.

Note that the cable guide member 54 is made of a nontransparent resin, and has: the plate section 541 that holds the wound portion of the cable 52 from above; and the mounting hole 543 formed at the center. However, the cable guide member 54 in this embodiment is not provided with the sidewall section 542, which is provided to the foregoing cable guide member 54 (see FIGS. 6 and 7).

In addition, FIG. 17 also partially illustrates the cover member 40. The cover member 40 is provided with a fixing hole 49 communicating with the screw hole 811 of the protrusion 81 and with the mounting hole 543 of the cable guide member 54.

Figure 18:
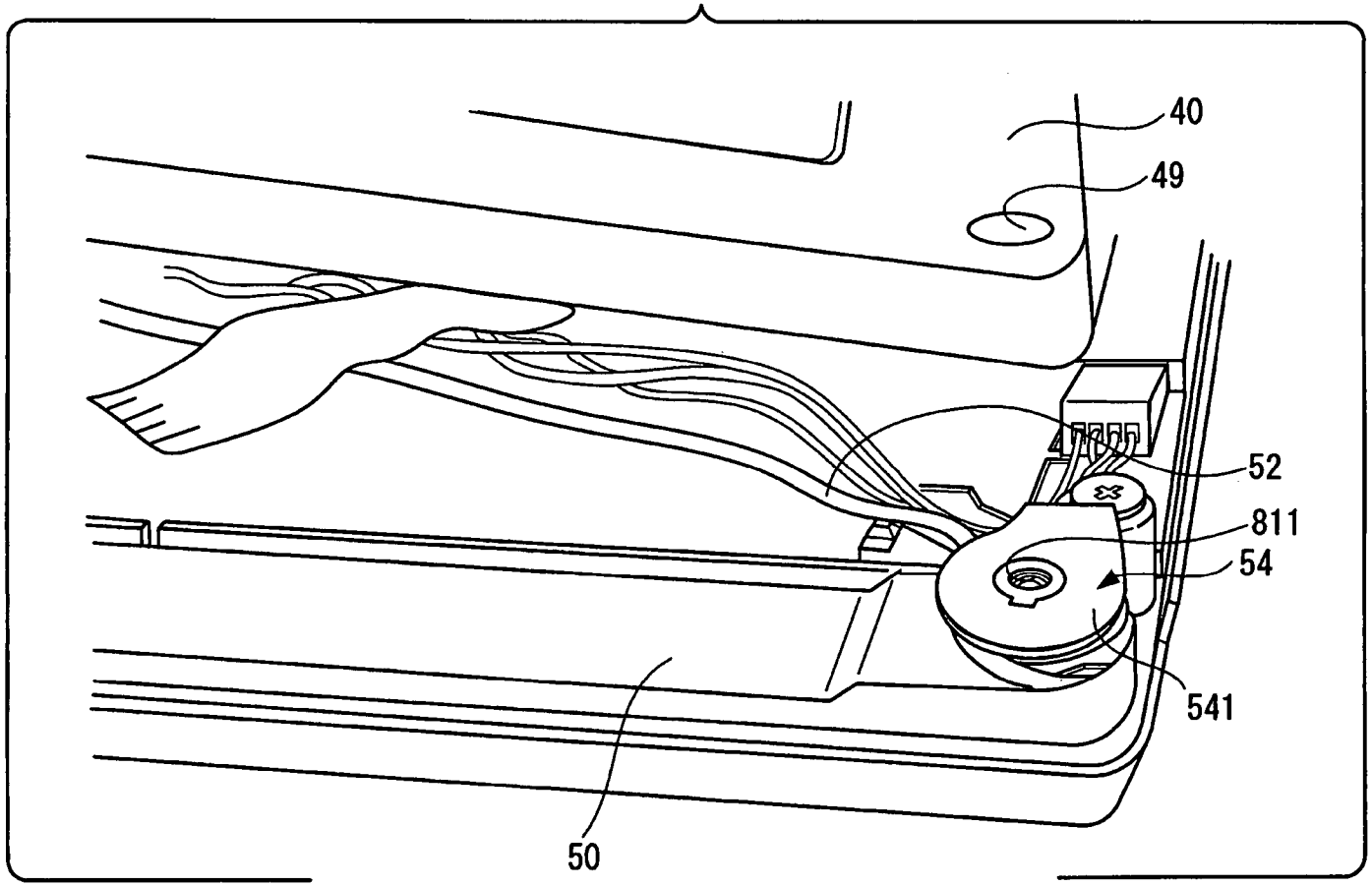
FIG. 18 is a perspective view illustrating the state where the cable guide member is placed on the wound portion of the cable.

FIG. 18 is a perspective view illustrating the state where the cable guide member 54 is placed on the wound portion of the cable 52.

In this state, the cable guide member 54 holds the wound portion of the cable 52 to keep the winding thereof, but is not screwed down.

After the state in FIG. 18, the cover member 40 is placed on the housing 20, and the cable guide member 54 is screwed down together with the cover member 40.

Figure 19:
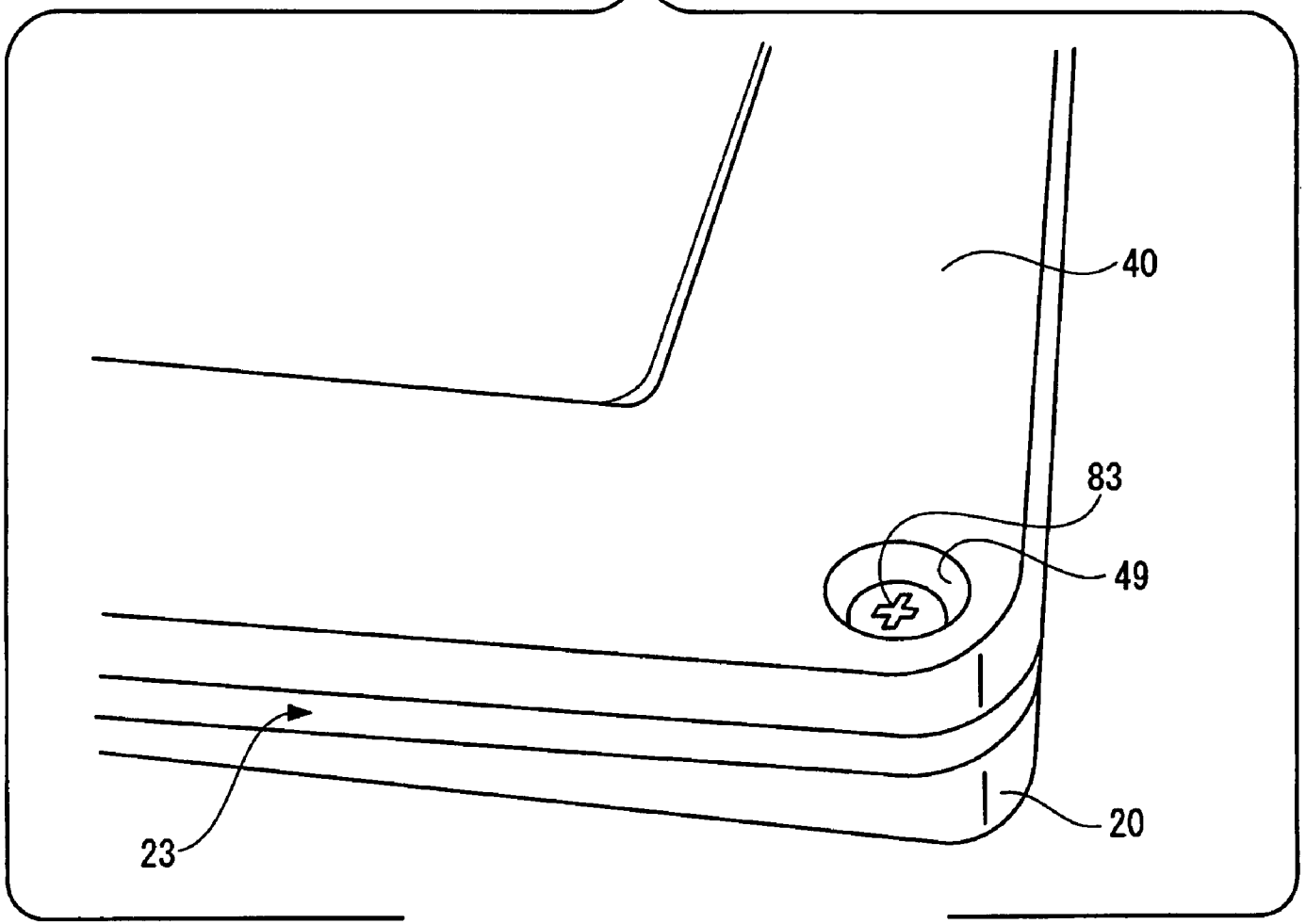
FIG. 19 is a perspective view illustrating the state where the cover member is screwed down.

FIG. 19 is a perspective view illustrating the state where the cover member 40 is screwed down.

The cover member 40 and the cable guide member 54 (see FIG. 18) covered therewith are fixed to the protrusion 81 (see FIG. 18) with the screw member 83.

Figure 20:
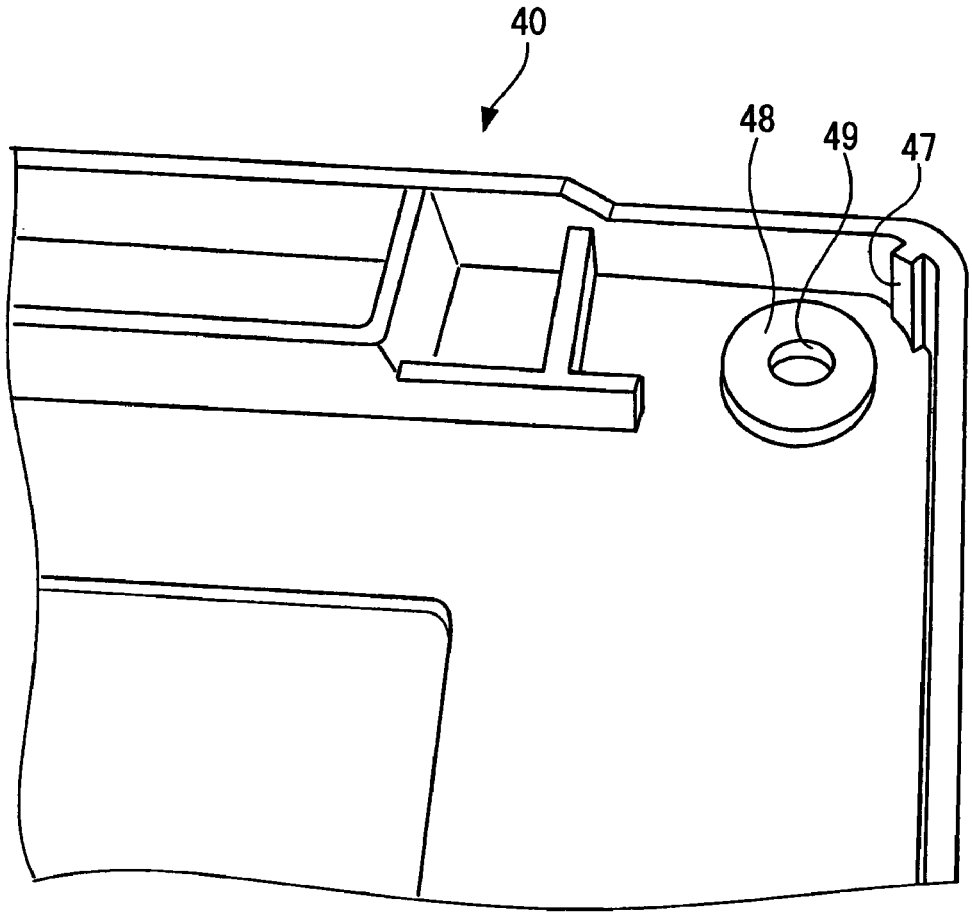
FIG. 20 is a perspective view partially illustrating the inner side of the cover member.

FIG. 20 is a perspective view partially illustrating the inner side of the cover member 40.

On the inner surface of the cover member 40, an annular protrusion 48 is formed to encircle the fixing hole 49. The protrusion 48 presses the cable guide member 54.

In addition, the cover member 40 has another protrusion 47 on the inner surface of its sidewall section. The protrusion has a function of preventing the wound portion of the cable 52 from coming loose, too.

In the embodiment illustrated in FIGS. 17 to 20, the antenna housing groove 23 extends surrounding the wounded portion of the cable 52. Hence, unless the cable 52 is largely displaced after the wounded portion of the cable 52 comes off the insertion hole 51 of the antenna unit 50, the cable 52 is kept from being caught between the housing 20 and the cover member 40. In this embodiment, by only placing the cable guide member 54 on the wounded portion of the cable 52, the wounded portion of the cable 52 is prevented from coming off the insertion hole 51 of the antenna unit 50, and thus from being caught between the housing 20 and the cover member 40.

Note that, though described by taking a slate PC as an example, the present invention is also applicable to other electronic devices such as a notebook PC.

The electronic device disclosed herein provides a structure that prevents assembly failure while allowing slack in a cable so that the cable follows the movement of the antenna.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alterations could be made hereto without departing from the spirit and scope of the invention.

What is claimed is:

1. An electronic device comprising:

a housing that has a rectangular plate section and a sidewall section provided upright on the plate section, and that houses electronic components therein, the sidewall section being provided with an antenna housing groove extending in a longitudinal direction of the sidewall section;

a protrusion that is provided upright at a point adjacent to one end of the antenna housing groove in the housing, the protrusion extending in a width direction of the antenna housing groove;

a plate piece-like antenna unit that has a length to be completely housed in the antenna housing groove and including a radio communication antenna, the antenna unit having, at one end, an insertion hole drilled through the antenna unit in a thickness direction thereof to allow the protrusion to be inserted therein, being housed in the antenna housing groove with the protrusion inserted in the insertion hole, and protruding from the housing by being rotated about the protrusion serving as a rotation shaft;

a cable that is connected to the one end of the antenna unit and wound about the insertion hole, and that extends from the insertion hole further inward of the housing away from the antenna unit; and a cable guide member that holds, between itself and the antenna unit, the portion of the cable wound about the insertion hole.

2. The electronic device according to claim 1, wherein the cable guide member has a plate section that holds, between itself and the antenna unit, the portion of the cable wound about the insertion hole, and a sidewall section that is provided upright from a peripheral edge of the plate section toward the antenna unit, and that surrounds the portion of the cable wound about the insertion hole.

3. The electronic device according to claim 2, wherein the cable is wound about the insertion hole in a direction in which the wound portion of the cable comes loose as the antenna unit rotates in a direction to protrude from the housing.

4. The electronic device according to claim 2, wherein the cable guide member is made of a light transmissive material through which the cable is visible.

5. The electronic device according to claim 2, wherein the cable guide member has a mounting hole through which a screw member is to be inserted, the protrusion has a screw hole, and the cable guide member is fixed to the protrusion with the screw member fastened in the screw hole after being inserted into the mounting hole.

6. The electronic device according to claim 5, further comprising a cover member covering at least a peripheral portion of the housing, wherein the cover member has a fixing hole communicating with the screw hole and the mounting hole, and the cable guide member is fixed, together with the cover member, to the protrusion with a screw member fastened in the screw hole after being inserted into the fixing hole and the insertion hole.

7. The electronic device according to claim 1, wherein the cable is wound about the insertion hole in a direction in which the wound portion of the cable comes loose as the antenna unit rotates in a direction to protrude from the housing.

8. The electronic device according to claim 1, wherein the cable guide member is made of a light transmissive material through which the cable is visible.

9. The electronic device according to claim 1, wherein the cable guide member has a mounting hole through which a screw member is to be inserted, the protrusion has a screw hole, and the cable guide member is fixed to the protrusion with the screw member fastened in the screw hole after being inserted into the mounting hole.

10. The electronic device according to claim 9, further comprising a cover member covering at least a peripheral portion of the housing, wherein the cover member has a fixing hole communicating with the screw hole and the mounting hole, and the cable guide member is fixed, together with the cover member, to the protrusion with a screw member fastened in the screw hole after being inserted into the fixing hole and the insertion hole.

* * * * *